US005088797A

United States Patent [19]

O'Neill

[11] Patent Number: 5,088,797

[45] Date of Patent: Feb. 18, 1992

[54] METHOD AND APPARATUS FOR HOLDING A CUTTING BIT

[75] Inventor: Michael L. O'Neill, Lucinda, Pa.

[73] Assignee: Joy Technologies Inc., Pittsburgh, Pa.

[21] Appl. No.: 578,908

[22] Filed: Sep. 7, 1990

[51] Int. Cl.[5] ..... F21C 35/18

[52] U.S. Cl. ..... 299/91; 175/413

[58] Field of Search ..... 299/79, 86, 91, 92, 299/93; 37/142 R; 175/413

[56] References Cited

U.S. PATENT DOCUMENTS

| | | | |
|---|---|---|---|
| 2,800,302 | 1/1952 | McClennan . | |
| 3,143,177 | 8/1964 | Galorneau et al. | 179/413 |
| 3,537,539 | 11/1970 | Adock | 179/413 |
| 3,717,209 | 2/1973 | Sheldon et al. | 175/413 |
| 3,771,612 | 11/1973 | Adcock | 175/413 |
| 3,841,708 | 10/1974 | Kniff et al. | 299/86 |
| 4,014,395 | 3/1977 | Pearson | 175/410 |
| 4,337,980 | 7/1982 | Krekeler | 299/91 |
| 4,478,299 | 10/1984 | Dorosz | 175/369 |
| 4,700,790 | 10/1987 | Shirley | 175/410 |

*Primary Examiner*—David J. Bagnell
*Attorney, Agent, or Firm*—Kirkpatrick & Lockhart

[57] ABSTRACT

A mining bit holding system is provided which includes a bit holder which attaches to the rotatable drum of a mining machine. The bit holder includes a base portion and a body portion. The body portion has an aperture therethrough to receive a sleeve. The sleeve has an aperture therethrough for rotatably receiving a cutting bit. The sleeve and bit holder are constructed such that the position of the sleeve may be fixed axially with respect to the body portion by an interference fit in such a manner that it may be easily removed from the body portion.

28 Claims, 5 Drawing Sheets

METHOD AND APPARATUS FOR HOLDING A CUTTING BIT

BACKGROUND OF THE INVENTION

1. Field of the Invention

The present invention relates to miner cutting bit holders and, in particular, to miner bit holder which includes a bit holder attached to a rotating cutting drum and which receives a pressed-in replaceable sleeve for rotatably receiving a cutting bit.

2. Description of the Invention Background

In the materials mining industry, it is typical to employ a mining apparatus which includes a vertically moveable rotating cutting drum which has cutting bits attached thereto. By virtue of the rotation of the cutting drum and the movement of the miner into the material to be mined, the material is removed for further processing.

It is well known that such cutting bits and their holders are subjected to considerable stresses during the mining operation. Such stresses occur axially, vertically and transverse relative to the cutting bit. Accordingly, in normal mining operations, cutting bits require frequent replacement due to wear or breakage. In fact, cutting bits must often be replaced on a daily basis. In view of these conditions, much effort has heretofore been directed to the provision of readily replaceable cutting bits which may be removed with a minimum of effort from their supports.

Because the bit holding devices are not the primary vehicles by which material is removed from the mine face, the service life. As such, bit holding systems have been developed which include a bit holder which retains the cutting bit and which may be mounted into the miner's cutting drum. While such bit holders typically allow the cutting bit to rotate to avoid uneven wear on the bit, they may alternatively, fix the cutting bit in one position. Nevertheless, the bit holders themselves are subject to considerable wear at the mine face and their breakage may require replacement on two to six month intervals. Further, when the bit holders are designed to allow bit rotation, such relative movement quickly wears the holding surfaces of the bit holder thereby rendering them unusable. It is well known that replacement of bit holders results in considerable expense and down time for the capital intensive mining machinery.

In an effort to address these problems, bit holding devices have been developed which include a replaceable sleeve disposed between the bit holder and the cutting bit. The use of these sleeves extends the life of the bit holders by limiting the internal wear to which the bit holder is subjected. In the past, sleeves have been either freely rotatable within the bit holder, or they have been permanently fixed in one position relative to the bit holder. The sleeve of the rotatable type has a longer service life than a nonrotatable sleeve due to even wearing on sleeve surfaces which contact the mine face. However, rotatable sleeves wear and ultimately destroy the internal surfaces of the bit holders in which they rotate.

Reference is made to my copending application Ser. No. 578,972, filed on the same date as the present application, entitled "Cutting Bit Holding Apparatus", which is directed to analogous concerns as this application and whose disclosure is hereby incorporated herein by reference.

In the past, certain non-rotatable sleeves have been held in place by means of an interference fit along the entire length of the sleeve. With this type of interference fit it is difficult, if not impossible, to remove the sleeve in the field. For example, forces in excess of 72,000 lbs. are necessary to remove some sleeves. Forces of such magnitude may not reasonably be generated in the extreme environments in which such cutting bits are used. I find that it would not be practical to provide an interference fit along the entire length of the sleeve which would allow its reasonable removal because the manufacturing tolerances which would be so required would be quite cost-prohibitive.

In certain applications, others have attempted to provide an interference fit directly between the bit holder and a cutting bit. Although Applicant believes these solutions are unsatisfactory because no sleeve is provided to prevent excessive wear on the bit holder, such configurations are shown in McLennan (U.S. Pat. No. 2,800,302) and Galorneau et al. (U.S. Pat. No. 3,143,177). Applicant is of the view that an additional fundamental flaw in those designs prohibits their use in mining bits which are subjected to massive axial loads. In those designs, the interference fits are formed by two (2) conical surfaces on the bit which engage a bore in the bit holder. However, because there is no shoulder provided to resist axial forces encountered during cutting, it is believed that the axial forces encountered in mining applications will cause the conical surfaces to split the bit holder.

Therefore, Applicant has discovered the need for a non-rotatable sleeve which will not cause excessive wear or destruction of the bit holder but which can be removed easily and quickly while the miner is in service conditions.

SUMMARY OF THE INVENTION

The present invention is directed to a mining bit holding system which includes a bit holder that attaches to the rotatable drum or cutting element of a mining machine. The bit holder includes a base portion and a body portion. The body portion has an aperture which is adapted to receive a sleeve. The sleeve is of unitary construction and includes a body member and preferably includes a collar forming a shoulder at one end to transmit axial forces to the body member while providing protection for the body member. The sleeve has a bore therethrough for rotatably receiving a cutting bit having an extended shaft.

The sleeve and bit holder are constructed such that the rotation of the sleeve may be prevented with respect to the body portion by means of an interference fit therebetween. Additionally, the sleeve and bit holder are constructed such that the sleeve may be removed in the mine from the body portion with a minimum of effort when replacement is indicated.

The provision of a sleeve having an interference fit allowing the removal of the sleeve is made possible by limiting the length over which interference exists. Preferably, one or more bands of interference are created between the sleeve and inner surface of the body portion. The sleeve can have interference surfaces along its length which are cylindrical, conical or a combination of cylindrical and conical. The body portion would have an aperture which is complementary to the sleeve and have corresponding interference surfaces. Alternatively, the interference band can be located adjacent either end of the sleeve or can be at some location along the length of the sleeve. I prefer that the bands of interference fit are cylindrical surfaces with an area of decreased diameter at the lower region of the bit holder aperture and an area of increased diameter near the leading end of the sleeve.

By providing bands of interference instead of an interference fit along the entire length of the sleeve, removal of the sleeve from the bit holder requires much less force than with bit holders that have interference along the entire length of the sleeve. The bit holder of the present invention has a sleeve which can be removed by the application of between 5000–20,000 lbs. of force. Such forces can be readily generated in the mine with means such as a punch or hydraulic device which is inserted behind the sleeve and through the application of mechanical advantage, forces the sleeve out of the aperture in the bit holder. The sleeve can thus be removed by manual means. As used herein, "Manual" refers to the use of a tool which may be hand-powered by a worker in field conditions to generate the forces in the order of 5,000–20,000 lbs. to remove the sleeve. With bands of interference fit, the sleeve has to be forcibly driven for only the length of the band. If an interference fit existed along the entire length of the sleeve, then the sleeve would have to be forcibly driven along its entire length, thus greatly increasing the amount of force necessary to remove the sleeve.

Accordingly, the present invention provides solutions to the aforementioned problems with miner bit holding apparatuses. As this invention provides a cutting bit holder and sleeve which allow the sleeve to be fixed in place with respect to the bit holder by means of an interference fit and which allows the sleeve to be removed from the bit holder, a design is provided which overcomes the problems with prior art bit holders.

These and other details, objects and advantages of the present invention will become apparent as the following description of the preferred embodiment thereof proceeds.

DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
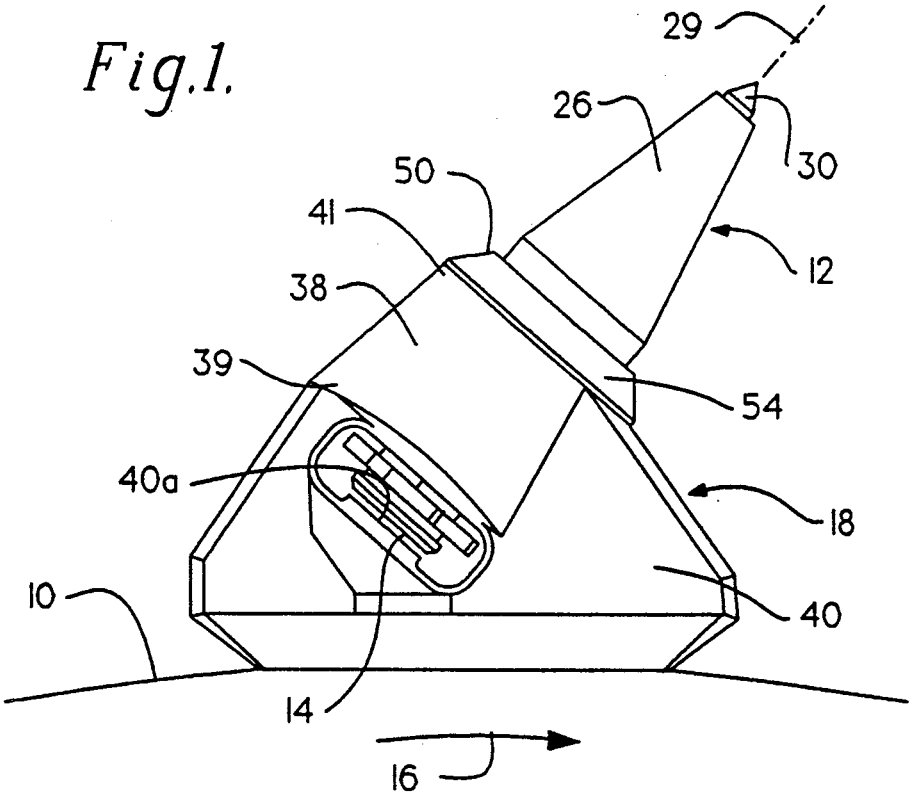
FIG. 1 is a side elevation view of the cutting bit holding apparatus according to the present invention.

Referring now to the drawings wherein the showings are for purposes of illustrating the present preferred embodiments of the invention only and not for purposes of limiting same, the Figures show a mining machine cutting drum 10 which supports a cutting bit 12 by means of a bit holder 18.

More particularly and with reference to FIG. 1, there is depicted the cutting drum 10 of a mining machine which is supported thereby for rotation in the direction shown by the arrow 16. As is well known in the art, the cutting drum 10 is supported by the mining machine for rotation while being vertically moveable and while the mining machine advances forward which may be viewed as left to right as shown in FIG. 1. As is also well known, the cutting drum 10 typically includes a plurality of cutting bits 12 arranged thereon; however, the present description will now be directed to a single cutting bit 12 and the structure of a single present bit holder 18.

Generally speaking, the bit holder 18 may be attached directly or indirectly to the drum 10. For example, the bit holder may be welded or clamped to the drum 10 or may be secured to a mounting block attached to the drum 10. As described hereinafter, the bit holder 18 receives and retains a sleeve 50 which rotatably receives the bit 12.

The cutting bit 12 may be of a previously established design including a central cylindrical shank portion 24 and having an enlarged conical nose 26 attached thereto such that a shoulder area 28 is formed therebetween. The cutting bit has a central axis shown at 29 with a hard cutting tip 30 on one end of the cutting bit 12 of a material and in a manner known in the art. The cutting bit 12 includes on its other end a recessed notch 32 and terminates in an end shoulder 34 such that a retaining ring (not shown) may be received within the notch 32 to prevent the axial removal of the cutting bit 12 from the sleeve 50.

In one embodiment of the invention, as seen in FIGS. 3, 4, 5 and 6, the bit holder 18 has a body portion 38 and a base portion 40. The base portion 40 attaches directly to the cutting drum 10 or indirectly by means of a mounting block (not shown). The body portion 38, which is integral to the base portion 40, includes an aperture 42 for receiving a coaxial sleeve 50. The aperture 42 defines an inner surface **42*a* which includes two segments of differing diameters, namely, a first segment 43 and a second segment 45 of slightly smaller diameter. The difference in diameter could be, for example on a diameter of segment 43 of one and seven-eights, on the order of one-thirty second of an inch. The body portion 38 has two ends, a trailing end 39 which faces away from the direction of rotation and the leading end 41 which faces toward the direction of rotation. The body portion 38 includes a contact face 44 which is shown as perpendicular to the longitudinal axis 46, which is the same as the central axis 29, of the aperture 42, but which may also be formed as a cone whose surface is at an angle with respect to the longitudinal axis 46 of the aperture 42**.

The sleeve 50 has an elongated body member 52 and a collar 54, the collar 54 having an inside surface 56 and an outside surface 5.. The inside surface 56 of the collar 54 abuts the contact face 44. The collar 54 is shown as having an inside surface 56 which is perpendicular to the longitudinal axis 46 of the aperture 42; however, the inside surface can be conical having a conical surface at an angle with respect to the longitudinal axis 46 corresponding to the angle of the contact face 44. The outside surface 58 of the collar 54 has a beveled surface 60 and a flat surface 62. The body member 52 of the sleeve 50 defines an outer surface 52a which also includes two segments of differing diameters, a first segment 53 and a second segment 55. The first segment 53 of the sleeve 50 is sized such that an interference fit is created between the first segment 53 of the sleeve 50 and the first segment 43 of the aperture 42. Similarly, the second segment 55 of the sleeve 50 is of an decreased diameter, such as by one-thirty second of an inch, so that an interference fit is created between the second segment 55 of the sleeve 50 and the second segment 45 of the aperture 42. The segments 43, 45, 53, 55, respectively, are of sufficient length such that an area of non-interference 57 is created. The amount of interference between the segments 43 and 53, respectively, and 45 and 55, respectively, is preferably between 0.002–0.005 inches. Such areas of interference are referred to as bands of interference and are shorter than the length of the sleeve. As will now be appreciated by those skilled in the art, in the machining of the aperture 42, and, by analogy, the body member 52, the diameter of the second segment 45 may be rough machined and then the diameter of the first segment 43 may be rough machined. Thereafter, the actual diameter of second segment 45 may be machined followed by the actual diameter of the first segment 43, but only in the area where segment 53 will engage it. As such actually three (3) diameters will be formed, the actual diameters of segments 43 and 45 and the rough diameter of segment 43, which is less than the preferred diameter 43 as by ten thousandths of an inch.

The body member 52 of the sleeve 50 has a bore 64 which is coaxial with the bit axis 29. The bit 12 is rotatably received by the bore 64. The shank 24 of the bit 12 is slightly smaller than the bore 64. The shank 24 is retained in the bore 64 by the retaining ring and the shank may rotate about the central axis 29 in order to avoid uneven wearing of the tip 30 of the cutting bit 12. The shoulder area 28 of the bit 12 abuts the flat surface 62 to position the bit 12 axially in the bore 64 and transmit cutting forces.

In preferred embodiments of the invention, the cutting bit 12 includes a bearing surface 14 at the end opposite the tip 30. The base portion 40 of the bit holder 18 has a corresponding anvil surface 40a which serves to absorb certain of the axial forces transmitted from the cutting bit 12. It will be understood by those skilled in the art that the combination of the bearing surface 14 and the anvil surface 40a is not required due to the additional manufacturing costs associated with the tolerances necessary to ensure proper mutual axial relationships, but these embodiments are intended to be included within the scope of this invention.

Figure 7:
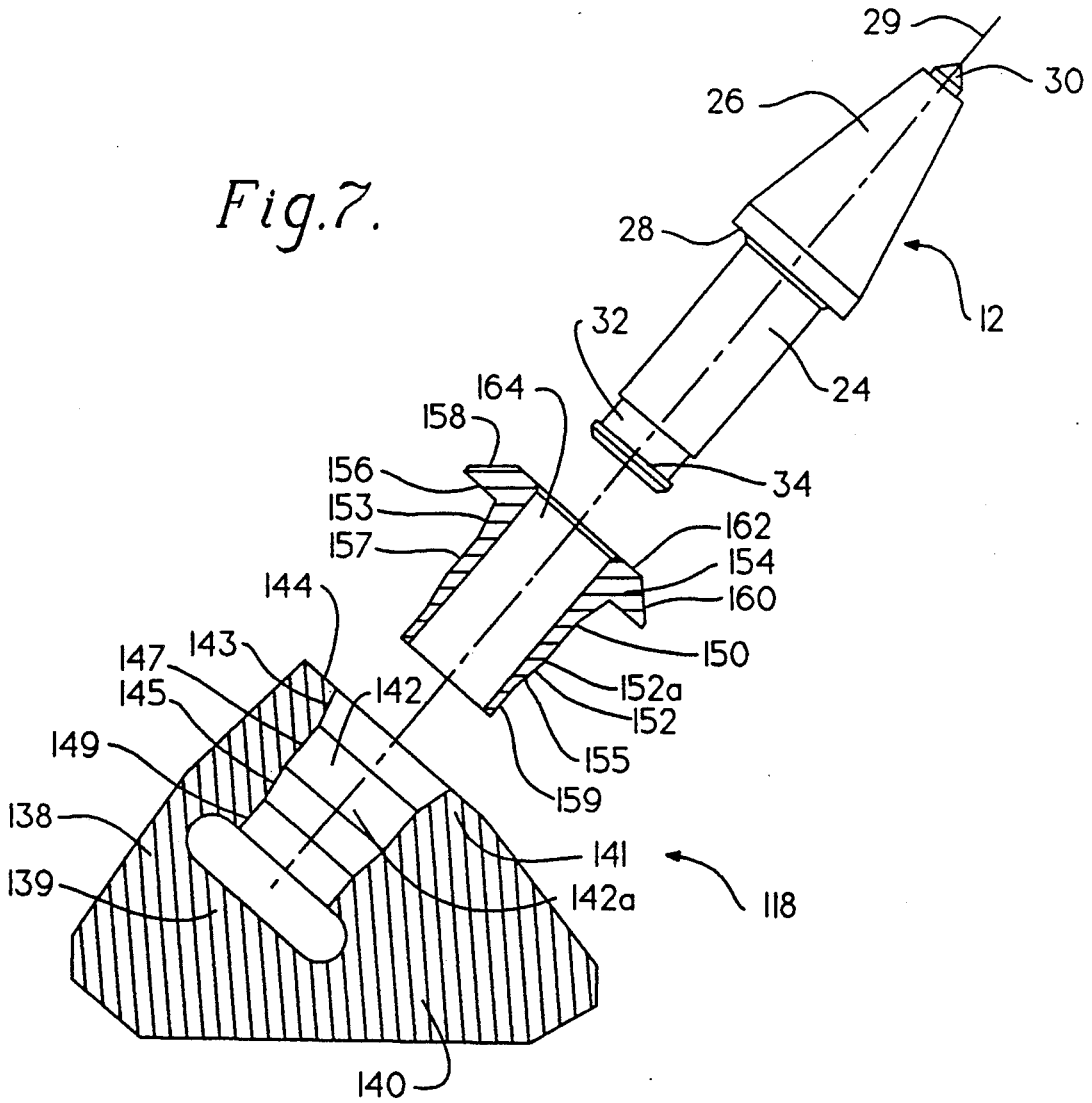
FIG. 7 is an exploded cross sectional view of another embodiment of the bit holder according to the present invention, again showing the bit as solid.
Figure 8:
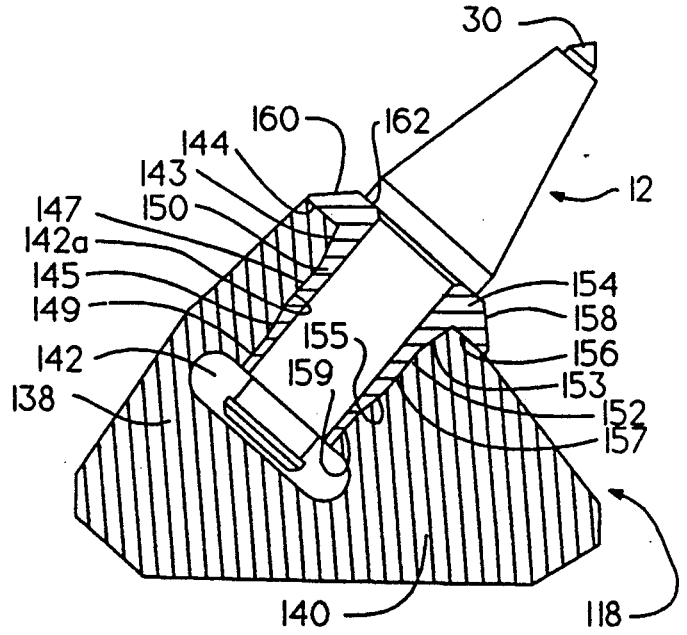
FIG. 8 is a cross sectional assembly view of the bit holding apparatus of FIG. 7 also showing the bit as solid.

In another embodiment, as seen in FIGS. 7 and 8 where the similar elements have the same reference numbers as described above as to FIGS. 3–6 and where analogous elements have referenced numerals which are increased by 100, the bit holder 118 has a body portion 138 and a base portion 140. The base portion 140 attaches directly to the cutting drum 10 or indirectly by means of a mounting block (not shown). The body portion 138, which is integral to the base portion 140, includes an aperture 142 for receiving a coaxial sleeve 150. The aperture 142 defines an inner surface 142a and includes two conical sections 143 and 145 which are formed as sections of different cones. Disposed between the conical sections 143 and 145 is a first parallel section 147 of the aperture 142 which is parallel to the longitudinal axis 146 of the aperture 142. As such, the minimum diameter of section 143 is preferably equal to the maximum diameter of section 45. A second parallel section 149 of the aperture 142 is located adjacent to the trailing end 139 of the body portion 138 and is also parallel to axis 146. It will be understood by those skilled in the art that the parallel sections 147 and 149 need not be parallel to the longitudinal axis 146 but are preferred to be as such for manufacturing purposes. The body portion also has a leading end 141 facing in the direction of rotation. The body portion 138 includes a contact face 144 which is shown as perpendicular to the longitudinal axis 146 which is the same as the central axis 29, of the aperture 142 but which may also be formed as a cone whose surface is at an angle with respect to the longitudinal axis 146 of the aperture 142.

The sleeve 150 has a body member 152 and a collar 154 with an inside surface 156 and an outside surface 158. The inside surface 156 of the collar 154 abuts the contact face 144. The outside surface 158 of the collar 154 has a beveled surface 160 and a flat surface 162. The body member 152 the sleeve 150 defines an outer surface 152a which has a geometry which is complementary to the aperture 142. The sleeve 150 includes two conical sections 153 and 155, respectively, corresponding to the conical sections 143 and 145, respectively. As such, the conical sections 143 and 153, respectively, and the conical sections 145 and 155 are at an acute angle relative to the axis 29 of the bit 12. Disposed between the conical sections 153 and 155 is a first parallel section 157 which corresponds to the first parallel section 147 of the aperture 142. A second parallel section 159 corresponds to the first parallel section 149 of the aperture 142. The conical sections 143 and 153 are sized such that an interference fit of, for example, 0.002–0.005 inch, exists therebetween. Similarly, the conical sections 145 and 155 are sized such that an interference fit of, for example 0.002–0.005 inch, exists therebetween. Such areas of interference are referred to as bands of interference and are shorter than the length of the sleeve. The first parallel sections 147 and 157 are sized such that no interference exists therebetween. Similarly, the second parallel sections 149 and 159 are sized such that no interference exists therebetween.

The collar 154 is shown as having an inside surface 156 which is perpendicular to the longitudinal axis 146 of the aperture 142; however, the inside surface 156 can be conical having a conical surface at an angle with respect to the longitudinal axis 146 corresponding to the angle of the contact face 144.

The body member 152 of the sleeve 150 has a bore 164. The bit 12 is rotatably received by the bore 164. The shank 24 of the bit 12 is slightly smaller than the bore 164. The bore 164 therefore retains the shank 24 via the retaining clip (not shown) while allowing it to rotate about the central axis 29 in order to avoid uneven wearing of the tip 30 of the cutting bit 12. The shoulder area 28 of the bit 12 abuts the flat surface 162 to position the bit 12 axially in the bore 164 and transmit cutting forces.

Figure 9:
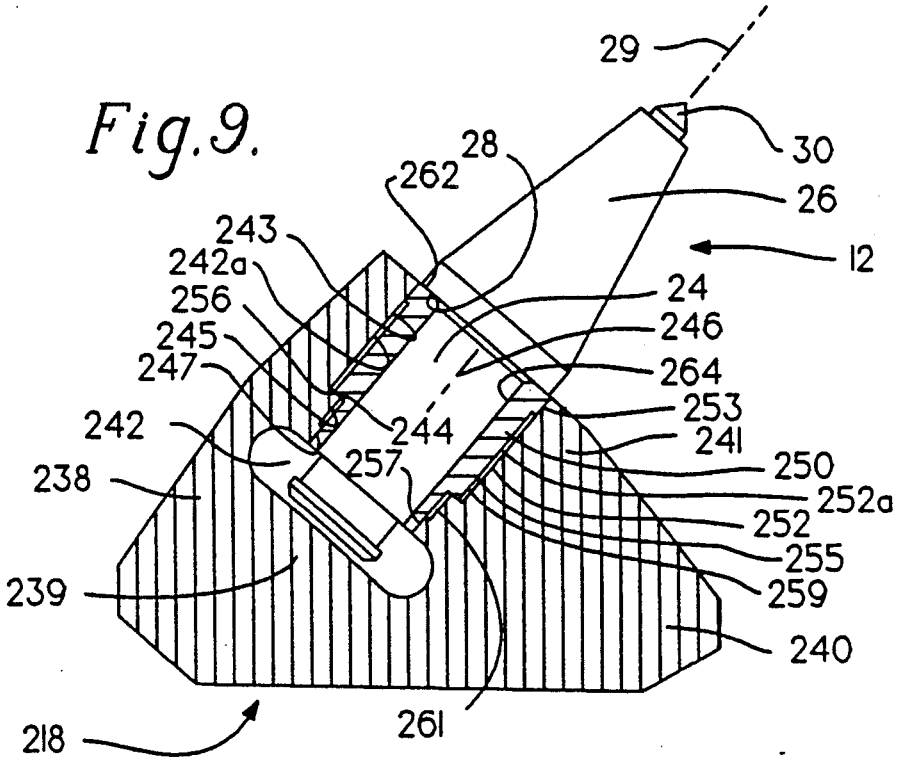
FIG. 9 is a cross sectional view of yet another embodiment of the invention which shows the bit as solid only for purposes of clarity.

In another embodiment, as seen in FIG. 9, where the similar elements have the same reference numbers as described above as to FIGS. 3–6 and where analogous elements have referenced numerals which are increased by 200, the bit holder 218 has a body portion 238 and a base portion 240. The base portion 240 attaches directly to the cutting drum 10 or indirectly by means of a mounting block (not shown). The body portion 238, which is integral to the base portion 240, includes an aperture 242 for receiving a coaxial sleeve 250. The aperture 242 defines an inner surface 242*a* which includes three segments of differing diameters, namely, a first segment 243, a second segment 245 of slightly smaller diameter and a third segment 247 of smaller diameter than the second segment 245. The difference in diameter between segments 245 and 247 could be, for example one-thirty second of an inch, while the difference in diameter between segments 243 and 245 could be three eighths of an inch. The body portion 240 has two ends, a trailing end 239 which faces away from the direction of rotation and the leading end 241 which faces toward the direction of rotation. The body portion 238 includes a contact face 244 at the junction of the segments 243 and 245 which is shown as perpendicular to the longitudinal axis 246 of the aperture 242 but may also be formed as a cone whose surface is at an angle with respect to the longitudinal axis 246 of the cutting bit.

The sleeve 250 has a body member 252 which has an outer surface 252*a* which also includes three segments of differing diameters, a first segment 253, a second segment 255, and a third segment 257. An abutment surface 256 is created at the junction of the segments 255 and 257. The abutment surface 256 is of complementary shape to and abuts the contact face 244. The first segment 253 of the sleeve 250 is sized such that an interference fit is created between the first segment 253 of the sleeve 250 and the first segment 243 of the aperture 242. Similarly, the third segment 257 of the sleeve 250 is sized such an interference fit is created between the third segment 257 of the sleeve 250 and the third segment 247 of the aperture 242. Such areas of interference are referred to as bands and are shorter than the length of the sleeve. The segments, 243, 247, 253, 257 are of sufficient length such that two areas of non-interference 259 and 261 are created. The amount of interference between the segments 253 and 243, respectively, and 257 and 247, respectively, is preferably between 0.002–0.005 inches.

The body member 252 of the sleeve 250 has a bore 264. The bit 12 is rotatably received by the bore 264. The shank 24 of the bit 12 is slightly smaller than the bore 264. The bore 264 therefore retains the shank 24 via the retaining clip (not shown) while allowing it to rotate about the central axis 29 in order to avoid uneven wearing of the tip 30 of the cutting bit 12. The shoulder area 28 of the bit 12 abuts the engagement surface 262 of the body member 252 to position the bit 12 axially in the bore 264 and transmit cutting forces.

Figure 2:
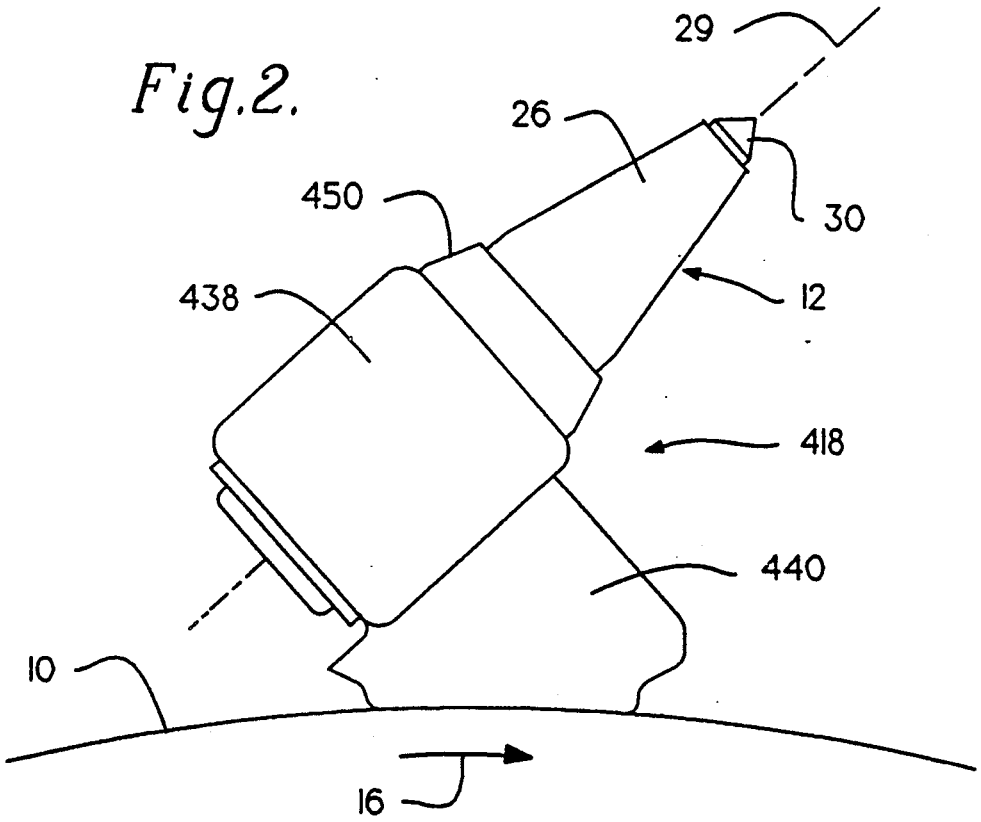
FIG. 2 is a side elevation view of another embodiment of the cutting bit holding apparatus according to the present invention.
Figure 3:
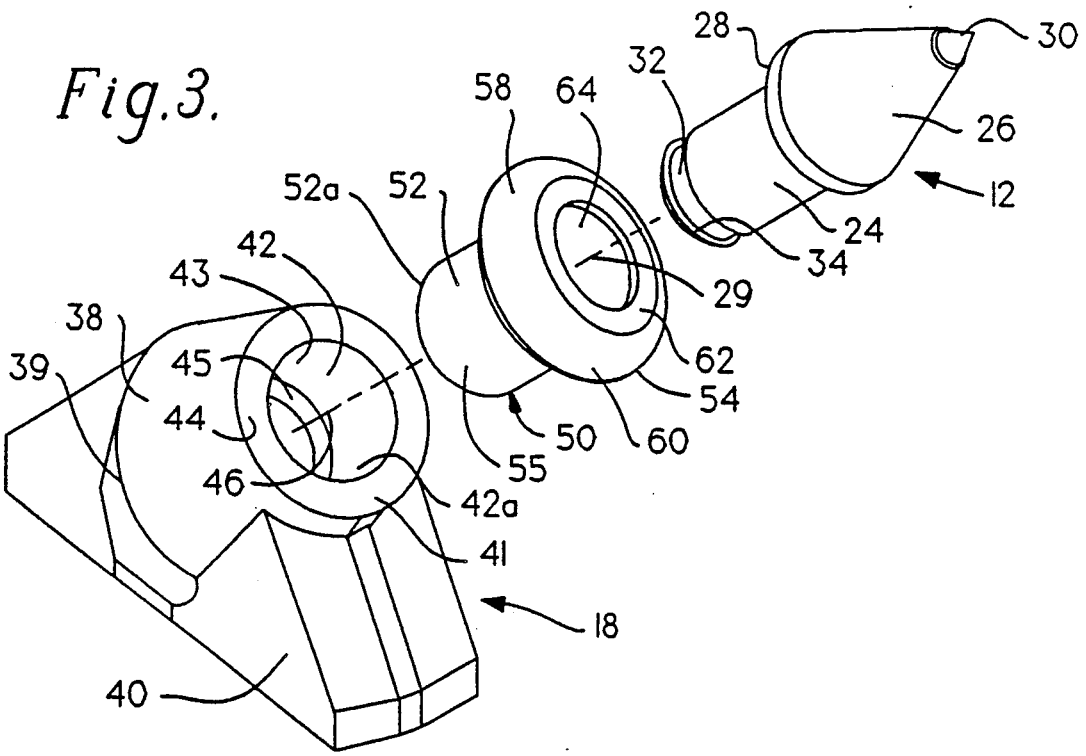
FIG. 3 is an exploded perspective view of one embodiment of the bit holding apparatus according to the present invention.
Figure 4:
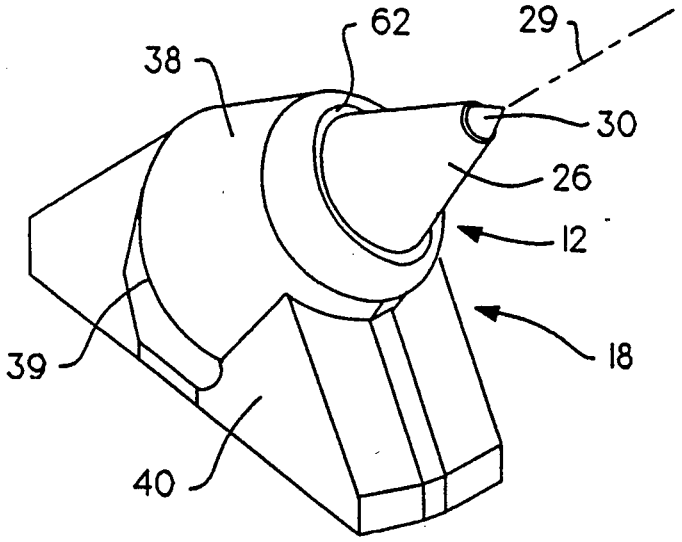
FIG. 4 is a perspective assembly view of the bit holding apparatus of FIG. 3.
Figure 5:
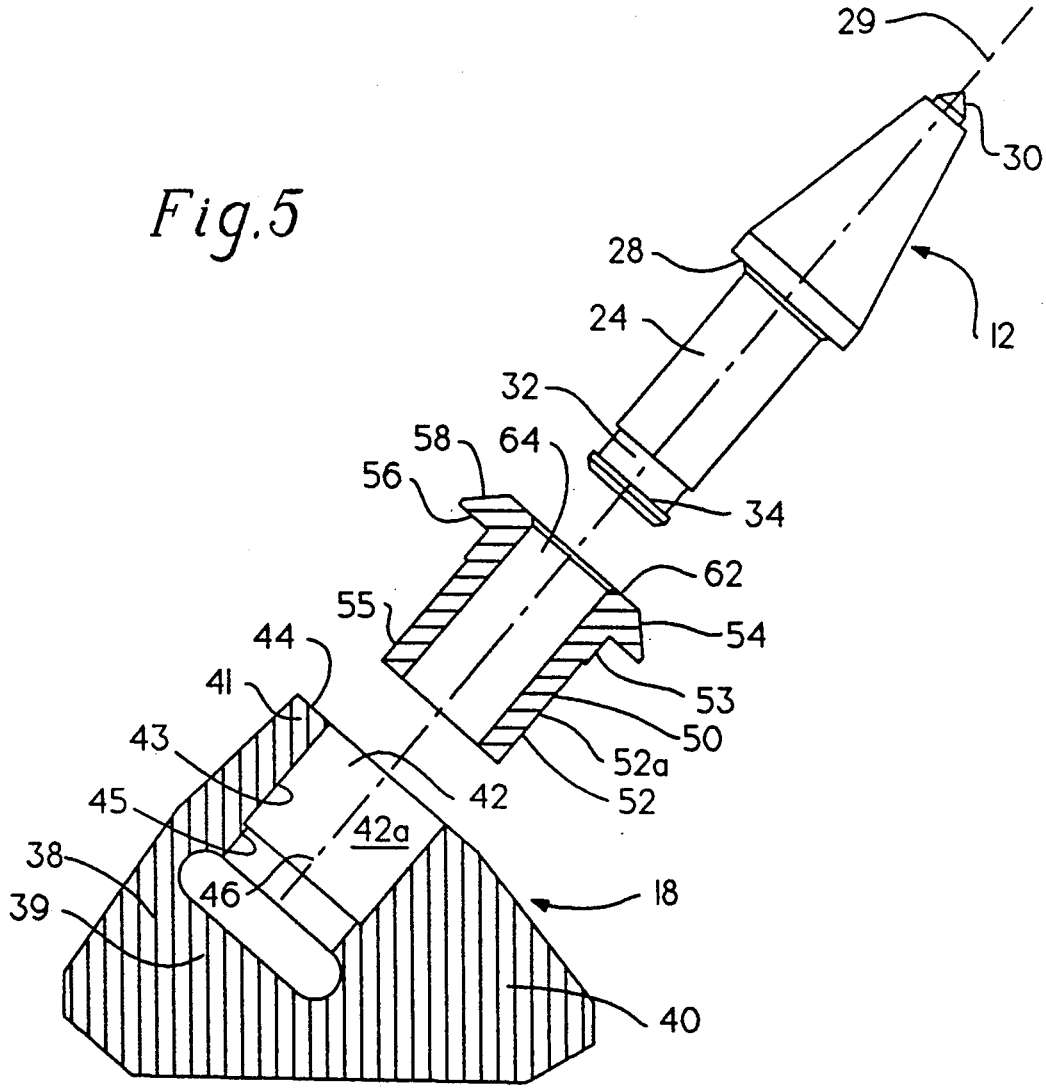
FIG. 5 is an exploded cross sectional view of one of the bit holding apparatus of FIG. 3 with the bit being shown as a solid for purposes of clarity.
Figure 6:
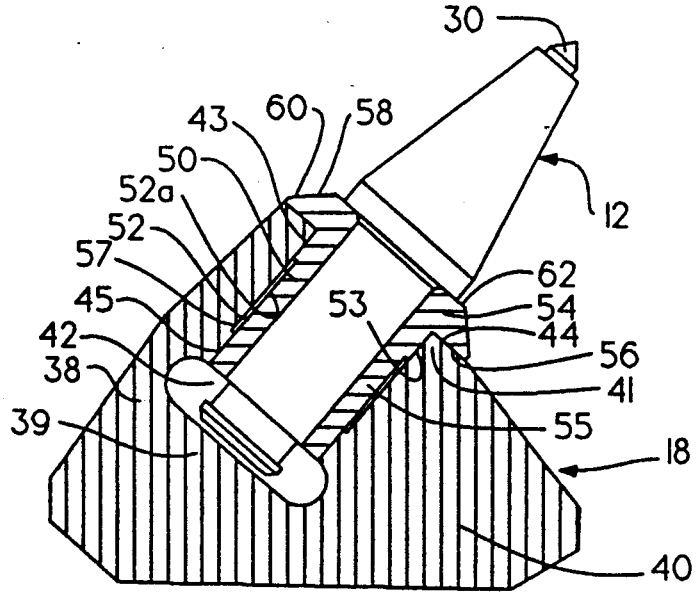
FIG. 6 is a cross sectional assembly view of the bit holding apparatus of FIG. 3 with the bit being shown as a solid for purposes of clarity.

It will be appreciated by those skilled in the art that the foregoing embodiments could be manufactured in conjunction with other styles of bit holders. For example, as seen in FIG. 2 where the similar elements have the same reference numbers as described above as to FIGS. 3–6 and where analogous elements have referenced numerals which are increased by 400, another type of bit holder 418 is depicted. The bit holder 418 has a body portion 438 and a base portion 440. The base portion 440 attaches directly to the cutting drum 10 or indirectly by means of a mounting block (not shown). The body portion 438, which is integral to the base portion 440, includes an aperture (not shown) for receiving a sleeve 450.

The body portion 438 and the sleeve 450 could be constructed according to the aforementioned embodiments. For example, the sleeve could be conical, cylindrical, or a combination of the two. The sleeve could have an external shoulder as seen in FIGS. 3–8 or could have an internal shoulder a seen in FIG. 9.

Reference may now be made to the operation of the bit holder as depicted in the accompanying Figures. Those skilled in the art will appreciate that the bands of interference fit between, for example, the sleeve 50 and body portion 38 of the bit holder 18 prevent the sleeve 50 from rotating when the cutting bit 12, sleeve 50 and bit holder 18 are subjected to the considerable forces generated during the mining operation. However, the bands of interference fit allow the sleeve 50 to be removed manually from the bit holder by application of a punch or hydraulic device while the bit holder 18 remains attached to the cutting drum 10 and the mining machine remains in the mine. The punch or hydraulic device would drive the sleeve 50 against the bands of interference to remove the sleeve from the bit holder 18.

As described above, I prefer that the amount of insertion or removal forces will be 5,000 to 20,000 lbs. It will be appreciated by those skilled in the art that the cutting bit holding apparatuses may also find utility on cutting apparatuses which do not have a rotating drum, for example, those which only impart a linear motion to the cutting bit. Moreover, cutting apparatuses which may advantageously employ this invention are found in other fields of endeavor such as in pavement removal apparatuses or any other apparatus for cutting hard surfaces such as those encountered relating to minerals.

It will be understood that various changes in the details, materials and arrangements of parts which have been herein described and illustrated in order to explain the nature of the invention, may be made by those skilled in the art within the principle and scope of the invention expressed in the appended claims.

What is claimed is:

1. Apparatus for supporting a cutting bit, the bit having an elongated shank and a shoulder, on a cutting element which is moveable in a cutting direction, comprising:

a bit holder having a base portion and a body portion, said base portion constructed for attachment to said cutting element, said body portion having a trailing end facing away from he cutting direction and a leading end facing in he cutting direction, said body portion further having a contact face and an aperture coaxial with the cutting bit and extending from said trailing end to said leading end and defining an inner surface;

a sleeve member having a body member constructed to be received in said aperture through said leading end of said body portion, aid body member defining an outer surface, said sleeve member having an abutment surface adapted for engagement with sad contact face to prevent axial movement of said sleeve member in a direction toward said trailing end, said sleeve member further having a bore therein for coaxially rotatably receiving the shank of the cutting bit and an engagement surface adapted to be engaged by the shoulder on the bit; and means for retaining said sleeve member relative to said body portion comprising an area of interference fit between said inner surface and said outer surface adapted to prevent rotation and axial movement of the sleeve while in use without the application of independent means for urging said sleeve member toward said trailing end of said bit holder and to allow the removal of said sleeve from said aperture of said body portion by the manual application of force to said sleeve member.

2. The apparatus of claim 1 wherein said means for retaining said sleeve member includes at least one band of interference fit between said inner surface and said outer surface which is shorter than said outer surface.

3. The apparatus of claim 1 wherein said means for retaining said sleeve member includes at least two discrete bands of interference fit between said inner surface and said outer surface.

4. The apparatus of claim 1 wherein said means for retaining said sleeve member includes at least one band of interference fit between said inner surface and said outer surface and wherein said sleeve is cylindrical.

5. The apparatus of claim 1 wherein said means for retaining said sleeve member includes at least two bands of interference fit between said inner surface and said outer surface and wherein said sleeve is cylindrical.

6. The apparatus of claim 1 wherein said means for retaining said sleeve member includes at least two bands of interference fit between said inner surface and said outer surface and wherein said sleeve includes at least two sections forming portions of a cone which are not part of the same cone.

7. The apparatus of claim 1 wherein said sleeve includes an area of increased diameter along said outer surface adjacent said leading end of said aperture and said aperture includes an area of reduced diameter adjacent said trailing end of said aperture such that two bands of interference fit exist between said outer surface and said inner surface, one at said area of increased diameter of said outer surface and the other at said area of reduced diameter of said inner surface.

8. Apparatus for supporting a cutting bit, the bit having an elongated shank and a should, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having a contact face on said leading end and an aperture coaxial with the cutting bit and extending from said trailing end to said leading end and defining an inner surface;

a sleeve member having a body member and a collar located at one end of said sleeve member, said body member constructed to be received by said aperture in said body portion through said leading end of said body portion, said body member defining an outer surface, said collar having an inside surface and an outside surface, said inside surface adapted for engagement with said contact face to prevent axial movement of said sleeve member in a direction toward said trailing end, said sleeve member further having a bore therein for rotatably receiving the shank of the cutting bit such that the shoulder engages said outside surface of said collar;

means for retaining said sleeve member relative to said body portion comprising an area of interference fit between said inner surface and said outer surface adapted to prevent rotation and axial movement of the sleeve while in use without the application of independent means for urging said sleeve member toward said trailing end of said bit holder and to allow the axial removal of said sleeve from said aperture of said body portion by the manual application of force to said sleeve member.

9. The apparatus of claim 8 wherein said means for retaining said sleeve member includes at least one band of interference fit between said inner surface and said outer surface which is shorter than said outer surface.

10. The apparatus of claim 8 wherein said means for retaining said sleeve member includes at least two discrete bands of interference fit between said inner surface and said outer surface.

11. The apparatus of claim 8 wherein said means for retaining said sleeve member includes at least one band of interference fit between said inner surface and said outer surface and wherein said sleeve is cylindrical.

12. The apparatus of claim 8 wherein said means for retaining said sleeve member includes at least two bands of interference fit between said inner surface and said outer surface and wherein said sleeve is cylindrical.

13. The apparatus of claim 8 wherein said means for retaining said sleeve member includes at least two bands of interference fit between said inner surface and said outer surface and wherein said sleeve includes at least two sections forming portions of a cone which are not part of the same cone.

14. The apparatus of claim 8 wherein said sleeve includes an area of increased diameter along said outer surface adjacent said leading end of said aperture and said aperture includes an area of reduced diameter adjacent said trailing the end of said aperture such that two bands of interference fit exist between said outer surface and said inner surface, one at said area of increased diameter of said outer surface and the other at said area of reduced diameter of said inner surface.

15. Apparatus for supporting a cutting bit, the bit having an elongated shank and a shoulder, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface;

a cylindrical sleeve member having a body member constructed to be received in said aperture through said leading end of said body portion, said body member defining an outer surface, said cylindrical sleeve member having an abutment surface adapted for engagement with said contact face to prevent axial movement of said cylindrical sleeve member in a direction toward said trailing end, said cylindrical sleeve member further having a bore therein for coaxially rotatably receiving the shank of the cutting bit and an engagement surface adapted to be engaged by the shoulder on the bit; and means for retaining said cylindrical sleeve member relative to said body portion comprising at least one band of interference fit between said inner surface and said outer surface adapted to prevent rotation and axial movement of said cylindrical sleeve while in use and to allow the removal of said cylindrical sleeve from said aperture of said body portion by the manual application of force to said cylindrical sleeve member.

16. The apparatus of claim 15 wherein said means for retaining said sleeve member includes at least two bands of interference fit between said inner surface and said outer surface.

17. The apparatus of claim 15 wherein said sleeve includes an area of increased diameter along said outer surface adjacent said leading end of said aperture and said aperture includes an area of reduced diameter adjacent said trailing end of said aperture such tat two bands of interference fit exist between said outer surface and said inner surface, one at said area of increased diameter of said outer surface and the other at said area of reduced diameter of said inner surface.

18. Apparatus for supporting a cutting bit, the bit having an elongated shank and a shoulder, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface;

a sleeve member having a body member constructed to be received in said aperture through said leading end of said body portion, said body member defining an outer surface, said sleeve member having an abutment surface adapted for engagement with said contact face to prevent axial movement of said sleeve member in a direction toward said trailing end, said sleeve member further having a bore therein for coaxially rotatably receiving the sank of the cutting bit and an engagement surface adapted to be engaged by the shoulder on the bit, said sleeve including at least two sections forming portions of a cone which are not part of the same cone; and means for retaining said sleeve member relative to said body portion comprising at least two bands of interference fit between said inner surface and said outer surface at said two sections adapted to prevent rotation and axial movement of the sleeve while in use and to allow the removal of said sleeve from said aperture of said body portion by the manual application of force to said sleeve member.

19. Apparatus for supporting a cutting bit, the bit having an elongated shank and a shoulder, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having a contact face on said leading end and an aperture coaxial with the cutting bit and extending from said trailing end to said leading end and defining an inner surface;

a cylindrical sleeve member having a body member and a collar located at one end of said cylindrical sleeve member, said body member constructed to be received by said aperture in said body portion through said leading end of said body portion, said body member defining an outer surface, said collar having an inside surface and an outside surface, said inside surface adapted for engagement with said contact face to prevent axial movement of said cylindrical sleeve member in a direction toward said trailing end, said cylindrical sleeve member further having a bore therein for rotatably receiving the shank of the cutting bit such that the shoulder engages said outside surface of said collar;

means for retaining said cylindrical sleeve member relative to said body portion comprising at least one band of interference fit between said inner surface and said outer surface adapted to prevent rotation and axial movement of the cylindrical sleeve while in use and to allow the axial removal of said cylindrical sleeve from said aperture of said body portion by the manual application of force to said cylindrical sleeve member.

20. The apparatus of claim 19 wherein said means for retaining said sleeve member includes at lest two bands of interference fit between said inner surface and said outer surface.

21. The apparatus of claim 19 wherein said sleeve includes an area of increased diameter along said outer surface adjacent said leading end of said aperture and said aperture includes an area of reduced diameter adjacent said trailing end of said aperture such that two bands of interference fit exist between said outer surface and said inner surface, one at said area of increased diameter of said outer surface and the other at said area of reduced diameter of said inner surface.

22. Apparatus for supporting a cutting bit, the bit having an elongated shank and a shoulder, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having a contact face on said leading end and an aperture coaxial with the cutting bit and extending from said trailing end to said leading end and defining an inner surface;

a sleeve member having a body member and a collar located at one end of said sleeve member, said body member constructed to be received by said aperture in said body portion through said leading end of said body portion, said body member defining an outer surface, said collar having an inside surface and an outside surface, said inside surface adapted for engagement with said contact face to prevent axial movement of said sleeve member in a direction toward said trailing end, said sleeve member further having a bore therein for rotatably receiving the shank of the cutting bit such that the shoulder engages said outside surface of said collar, said sleeve including at least two sections forming portions of a cone which are not part of the same cone; and means for retaining said sleeve member relative to said body portion comprising at least two bands of interference fit between said inner surface and said outer surface at said two sections adapted to prevent rotation and axial movement of the sleeve while in use and to allow the axial removal of said sleeve from said aperture of said body portion by the manual application of force to said sleeve member.

23. An apparatus for cutting, comprising:

a moveable cutting element which is moveable in a cutting direction; and a plurality of apparatuses mounted on said cutting element for supporting a plurality of cutting bits, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface, a sleeve member having a body member constructed to be received in said aperture through said leading end of said body portion, said body member defining an outer surface, said sleeve member having an abutment surface adapted for engagement with said contact face to prevent axial movement of said sleeve member in a direction toward said trailing end, said sleeve member further having a ore therein for coaxially rotatably receiving the shank of the cutting bit and an engagement surface adapted to be engaged by the shoulder on the bit, and means for retaining said sleeve member relative to said body portion comprising an area of interference fit between said inner surface and said outer surface adapted to prevent rotation and axial movement of the sleeve while in use without the application of independent means for urging said sleeve member toward said trailing end of said bit holder and to allow the removal of said sleeve from said aperture of said body portion by the manual application of force to said sleeve member.

24. An apparatus for cutting, comprising:

a moveable cutting element which is moveable in a cutting direction; and a plurality of apparatuses mounted on said cutting element for supporting a plurality of cutting bits, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface, a cylindrical sleeve member having a body member constructed to be received in said aperture through said leading end of said body portion, said body member defining an outer surface, said cylindrical sleeve member having an abutment surface adapted for engagement with said contact face to prevent axial movement of said cylindrical sleeve member in a direction toward said trailing end, said cylindrical sleeve member further having a bore therein for coaxially rotatably receiving the shank of the cutting bit and an engagement surface adapted to be engaged by the shoulder on the bit, and means for retaining said cylindrical sleeve member relative to ad body portion comprising at least one band of interference fit between said inner surface and said outer surface adapted to prevent rotation and axial movement of said cylindrical sleeve while in use and to allow the removal of said cylindrical sleeve from said aperture of said body portion by the manual application of force to said cylindrical sleeve member.

25. An apparatus for cutting, comprising:

a moveable cutting element which is moveable in a cutting direction; and a plurality of apparatuses mounted on said cutting element for supporting a plurality of cutting bits, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface;

a sleeve member having a body member constructed to be received in said aperture through said leading end of said body portion, said body member defining an outer surface, said sleeve member having an abutment surface adapted for engagement with said contact face to prevent axial movement of said sleeve member in a direction toward said trailing end, said sleeve member further having a bore therein for coaxially rotatably receiving the shank of the cutting bit and an engagement surface adapted to be engaged by the shoulder on the bit, said sleeve including at least two sections forming portions of a cone which are not part of the same cone; and means for retaining said sleeve member relative to said body portion comprising at least two bands of interference fit between said inner surface and said outer surface at said two sections adapted to prevent rotation and axial movement of the sleeve while in use and to allow the removal of said sleeve from said aperture of said body portion by the manual application of force to said sleeve member.

26. A method of cutting a material to be mined, comprising:

providing a cutting apparatus, said cutting apparatus including a moveable cutting element which is moveable in a cutting direction, and a plurality of apparatuses mounted on said cutting element each supporting a cutting bit, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface, a sleeve member having a body member constructed to be received in said aperture through said leading end of said body portion, said body member defining an outer surface, said sleeve member having an abutment surface adapted for engagement with said contact face to prevent axial movement of said sleeve member in a direction toward said trailing end, said sleeve member further having a bore therein for coaxially rotatably receiving the shank of the cutting bit and an engagement surface adapted to be engaged by the shoulder on the bit, and means for retaining said sleeve member relative to said body portion comprising an area of interference fit between said inner surface and said outer surface adapted to prevent rotation and axial movement of the sleeve while in use without the application of independent means for urging said sleeve member toward said trailing end of said bit holder and to allow the removal of said sleeve from said aperture of said body portion by the manual application of force to said sleeve member;

moving said cutting element in said cutting direction; and moving said cutting apparatus into the material to be mined such that the cutting bits contact and cut the material.

27. A method of cutting a material to be mined, comprising:

providing a cutting apparatus, said cutting apparatus including a moveable cutting element which is moveable in a cutting direction, and a plurality of apparatuses mounted on said cutting element each supporting a cutting bit, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface, a cylindrical sleeve member having a body member constructed to be received in said aperture through said leading end of said body portion, said body member defining an outer surface, said cylindrical sleeve member having an abutment surface adapted for engagement with said contact face to prevent axial movement of said cylindrical sleeve member in a direction toward said trailing end, said cylindrical sleeve member further having a bore therein for coaxially rotatably receiving the shank of the cutting bit and an engagement surface adapted to be engaged by the shoulder on the bit, and means for retaining said cylindrical sleeve member relative to said body portion comprising at least one band of interference fit between said inner surface and said outer surface adapted to prevent rotation and axial movement of said cylindrical sleeve while in use and to allow the removal of aid cylindrical sleeve from said aperture of said body portion by the manual application of force to said cylindrical sleeve member;

moving said cutting element in said cutting direction; and moving said cutting apparatus into the material to be mined such that the cutting bits contact and cut the material.

28. A method of cutting a material to be mined, comprising:

providing a cutting apparatus, said cutting apparatus including a moveable cutting element which is moveable in a cutting direction, and a plurality of apparatuses mounted on said cutting element each supporting a cutting bit, each bit having an elongated shank and a shoulder, each of said support apparatuses including a bit holder having a base portion and a body portion, said base portion constructed for attachment to said cutting element, said body portion having a trailing end facing away from the cutting direction and a leading end facing in the cutting direction, said body portion further having a contact face and an aperture coaxial with the cutting bit and extending from said trailing end to said leading end and defining an inner surface;

a sleeve member having a body member constructed to be received in said aperture through said leading end of said body portion, said body member defining an outer surface, said sleeve member having an abutment surface adapted for engagement with said contact face to prevent axial movement of said sleeve member in a direction toward said trailing end, said sleeve member further having a bore therein for coaxially rotatably receiving the shank of the cutting bit and an engagement surface adapted to be engaged by the shoulder on the bit, said sleeve including at least two sections forming portions of a cone which are not part of the same cone; and means for retaining said sleeve member relative to said body portion comprising at least two bands of interference fit between said inner surface and said outer surface at said two sections adapted to prevent rotation and axial movement of the sleeve while in use and to allow the removal of said sleeve from said aperture of said body portion by the manual application of force to said sleeve member;

moving said cutting element in said cutting direction; and moving said cutting apparatus into the material to be mined such that the cutting bits contact and cut the material.

* * * * *

UNITED STATES PATENT AND TRADEMARK OFFICE

CERTIFICATE OF CORRECTION

PATENT NO. : 5,088,797

DATED : February 18, 1992

INVENTOR(S) : Michael L. O'Neill

It is certified that error appears in the above-identified patent and that said Letters Patent is hereby corrected as shown below:

On the title page, item (56):

In the References Cited, delete "Adock" and substitute --Adcock-- therefor.

Col. 1, line 34, after "the" add --bit holding devices are generally characterized by a longer--.

Col. 5, line 1, delete "5.." and substitute --58.-- therefor.

Col. 6, line 10, delete "45" and substitute --145-- therefor.

Col. 6, line 29, after "152" add --of--.

Col. 7, line 40, after "such" add --that--.

Col. 8, line 11, delete "a" and insert --as--.

Col. 8, line 53, delete "he" and substitute --the-- therefor.

Col. 8, line 54, delete "he" and substitute --the-- therefor.

Col. 8, line 61, delete "aid" and substitute --said-- therefor.

UNITED STATES PATENT AND TRADEMARK OFFICE

CERTIFICATE OF CORRECTION

PATENT NO. : 5,088,797

DATED : February 18, 1992

INVENTOR(S) : Michael L. O'Neill

It is certified that error appears in the above-identified patent and that said Letters Patent is hereby corrected as shown below:

Col. 8, line 63, delete "sad" and substitute --said-- therefor.

Col. 9, line 46, delete "should" and substitute --shoulder-- therefor.

Col. 11, line 18, delete "tat" and substitute --that-- therefor.

Col. 11, line 44, delete "sank" and substitute --shank-- therefor.

Col. 12, line 28, delete "lest" and substitute --least-- therefor.

Col. 13, line 35, delete "ore" and insert --bore--.

Col. 14, line 13, delete "ad" and substitute --said-- therefor.

UNITED STATES PATENT AND TRADEMARK OFFICE

CERTIFICATE OF CORRECTION

PATENT NO. : 5,088,797

DATED : February 18, 1992

INVENTOR(S) : Michael L. O'Neill

It is certified that error appears in the above-identified patent and that said Letters Patent is hereby corrected as shown below:

Column 16, line 12, delete "aid" and insert --said--.

Signed and Sealed this

Twenty-first Day of December, 1993

*Attest:*

*Attesting Officer*

Bruce Lehman

BRUCE LEHMAN

*Commissioner of Patents and Trademarks*